US006688507B2

(12) United States Patent
McCormack

(10) Patent No.: US 6,688,507 B2
(45) Date of Patent: Feb. 10, 2004

(54) EYEGLASS HOLDING DEVICE

(76) Inventor: Corinne McCormack, 55 E. 87th St., New York, NY (US) 10128

( * ) Notice: Subject to any disclaimer, the term of this patent is extended or adjusted under 35 U.S.C. 154(b) by 7 days.

(21) Appl. No.: 10/307,193

(22) Filed: Nov. 27, 2002

(65) Prior Publication Data

US 2003/0131449 A1 Jul. 17, 2003

(51) Int. Cl.[7] ..... A44B 21/00; A45F 5/00

(52) U.S. Cl. ..... 224/604; 24/3.3; 224/247; 224/257

(58) Field of Search ..... 224/603, 604, 224/646, 247, 257; 24/3.3, 327, 489, 568

(56) References Cited

U.S. PATENT DOCUMENTS 4,894,887 A * 1/1990 Ward, II ..... 24/3.3
5,305,934 A * 4/1994 Grey ..... 24/3.3
5,319,838 A * 6/1994 Eppenauer ..... 24/3.3
5,893,198 A * 4/1999 DeCotis ..... 24/3.3
6,076,925 A * 6/2000 Kraut ..... 24/3.3
6,533,414 B2 * 3/2003 Newler ..... 224/251
6,539,587 B2 * 4/2003 Harrison ..... 24/3.3

* cited by examiner

*Primary Examiner*—Gary E. Elkins
(74) *Attorney, Agent, or Firm*—William J. Sapone; Coleman Sudol Sapone, P.C.

(57) ABSTRACT

An eyeglass holding assembly has a first element having a first diameter, and a second element having a second diameter, the second diameter being smaller than the first diameter. A hinge is fixedly engaged to the first element and hingedly engaged to the second element. The hinge preferably has a spring for biasing the second element into close proximity with the first element. In use, an arm of a pair of eyeglasses is slipped between the first and second elements such the pair of eyeglasses are supported by the first element and are retained by the second element which is in proximity with the first element to limit inadvertent upward movement of the eyeglasses.

8 Claims, 3 Drawing Sheets

EYEGLASS HOLDING DEVICE

TECHNICAL FIELD

This invention relates an eyeglass holding device for holding eyeglasses on a necklace.

BACKGROUND

A common problem for persons wearing eyeglasses is where to temporarily place those eyeglasses when not in use. Many users of eyeglasses occasionally have a need to temporarily remove their eyeglasses, with concurrent need to have ready access to the eyeglasses, generally within easy reach. Eyeglasses are often lost or misplaced when put down in such situations. While a person could place the eyeglasses in a shirt or coat pocket, this is usually inconvenient and often can result in the eyeglasses falling out or in the frames being bent.

In U.S. Pat. No. 5,893,198, an eyeglass holder necklace assembly is described which has a loop suspended on a necklace via a pair of swivel linkers which are rotatable a full 360 degrees, such that twisting or kinking of the necklace is relieved by the swivel linkers. However, the eyeglasses remain freely moveable on the loop, and are only retained by gravity in contact with the loop such that movement can result in dislodgement of the eyeglasses.

SUMMARY OF THE INVENTION

It is an object of the present invention to provide an eyeglass holding assembly that can positively retain and hold a pair of eyeglasses within easy reach of the user.

It is a further object of the present invention to provide an eyeglass holding assembly which is simple in design and construction, but which provides positive retention of the eyeglasses on a necklace worn around the neck, to prevent loss of the eyeglasses, without the use of any swiveling assemblies.

These and other objects of the present invention are achieved by an eyeglass holding assembly comprising a first element having a first diameter, and a second element having a second diameter, the second diameter being smaller than the first diameter, a hinge fixedly engaged to the first element and hingedly engaged to the second element, the first element having an opening of a size sufficient to accept an arm of a pair of eyeglasses therein, the arm received between the first element and the second element such that the pair of eyeglasses are supported by the first element and are positively retained by the second element in proximity therewith. In a preferred embodiment, the hinge has biasing means for biasing the second element into close proximity with the first element.

Using the present invention, a pair of eyeglasses may be supported by resting in the opening on the first element, the second element disposed in close proximity with the first element to positively engage and prevent substantial movement and dislodgement of the eyeglasses retained therebetween. In the preferred embodiment, the biasing means assists in keeping the hinged second element in an eyeglass retaining position, the biasing force being easily overcome by manual pressure so that the user can easily insert or remove the eyeglasses from the eyeglass holding assembly.

BRIEF DESCRIPTION OF THE DRAWINGS

FIG. **6*a* is a front view of an alternative embodiment of the present invention.

DETAILED DESCRIPTION OF THE INVENTION

Figure 1:
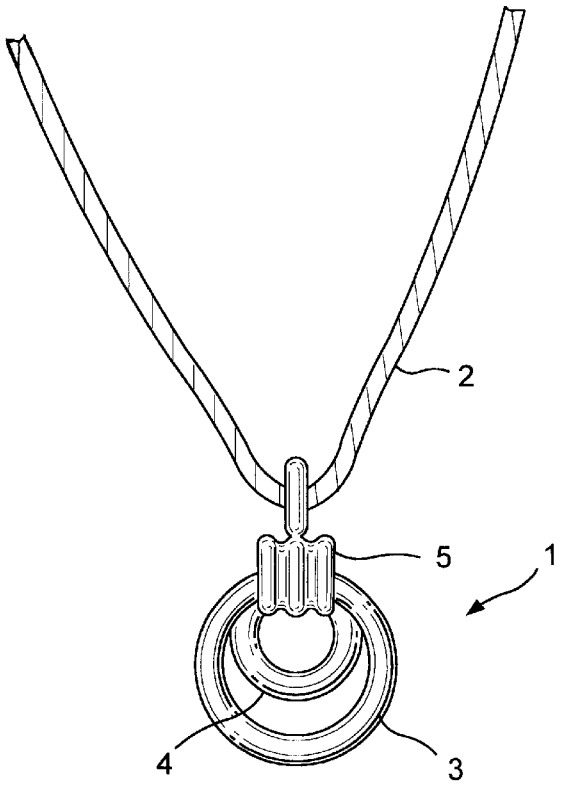
FIG. 1 is an view of the eyeglass holding assembly of the present invention.

Referring to FIG. 1, an eyeglass holding assembly 1 is supported by a necklace 2 having a first element 3, that in this embodiment is ring shaped, and a second element 4, also for convenience shown to have a ring shape, suspended from a hinge 5 anchored on the first element. The first element has a larger diameter than the second element in a relationship sufficient to enable ease of entry of an arm of a pair of eyeglasses between the elements. By having the second element at least slightly smaller than the first ring, it is relatively simple to slide the arm of the eyeglasses between the elements. The amount of space between the receiving ends of the elements can vary from contacting proximity to a gap of up to about ¼ inch, beyond which the degree of retention may be somewhat lessened.

Figure 2:
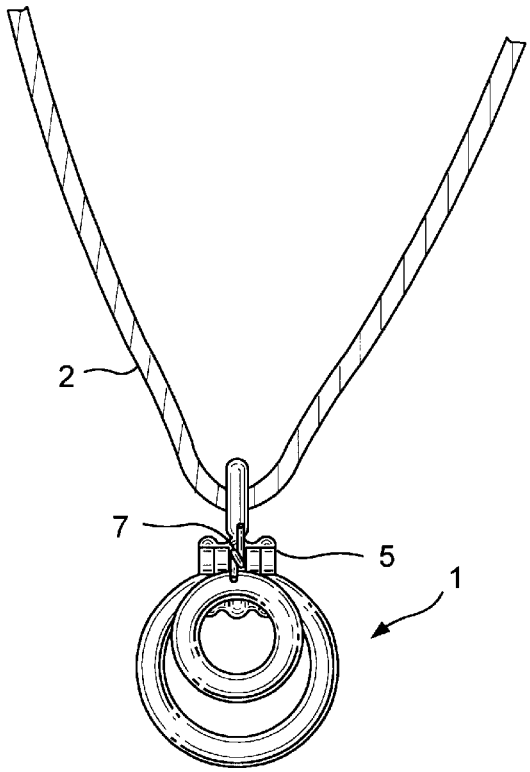
FIG. 2 is a rear view thereof.
Figure 3:
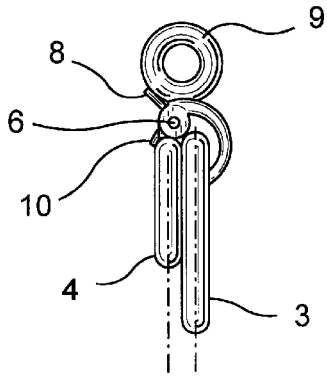
FIG. 3 is a side view thereof.
Figure 4:
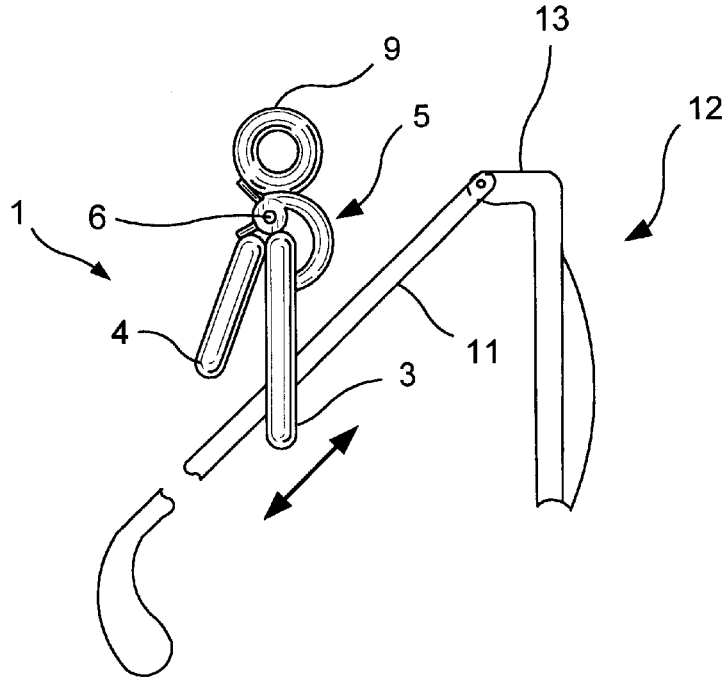
FIG. 4 is a side view showing the receipt of a pair of eyeglasses by the eyeglass holding assembly.

As shown in FIGS. 2 and 3, in this embodiment, the second element is optionally slightly offset from a center line of the first element, so as to further ease insertion of an arm of a pair of eyeglasses between the elements.

The hinge 5 has a pivot 6 which allows the second element to rotate inwardly away from the direction of entry of the arm of a pair of eyeglasses when entering the space between the elements. The hinge has an optional spring 7, with a first end 8 resting against a fixed necklace receiving loop 9, and a second end 10 resting against the second element for biasing the second element into close proximity with the first element.

Figure 5:
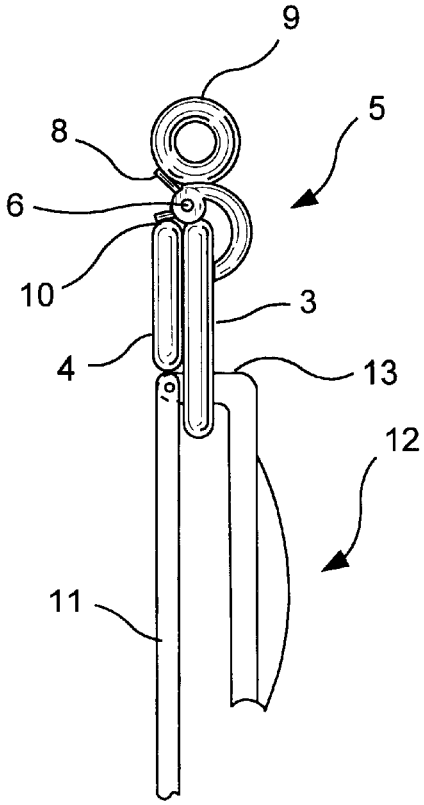
FIG. 5 is a side view showing the retention of a pair of eyeglasses by the eyeglass holding assembly.

Referring to FIG., 4, insertion of an arm 11 of a pair of eyeglasses 12 into the opening of the first element moves the second element away from the first element to ease entry. After the eyeglasses are received, a portion of the eyeglass frame 13 rests on and is supported by the first element, as shown in FIG. 5.

After the arm 11 has been received, the spring biases and moves the second element back to its close proximity position relative to the first element, such that the second element is either in contact with or close proximity to the portion 13 of the eyeglasses, which inhibits any upward movement of the eyeglasses. This prevents the eyeglasses from being inadvertently removed from the supporting position on the first element, to positively retain or lock the eyeglasses in their received position.

Withdrawal of the eyeglasses is readily accomplished by the user applying manual force to press in the second element, whether or not spring biased, while pulling the eyeglasses out of the opening in the first element.

While elements with a "ring shape" have been shown for convenience, the invention is not limited as to the shape of use of ring shapes. The first and second elements may have the same shape or be of different shapes. Either or both elements may be round, oval, square, rectangular, triangular, or another geometric shape, or be of purely arbitrary shape in the form of a design element, having for example, a heart shape, a star shape, etc., such that the eyeglass holding device has an aesthetically pleasing appearance. While the first element has an opening for receiving an arm of a pair of eyeglasses, this also can be of diverse shapes, provided it is sized to accept the arm passing therethrough. The second element may have an opening or have no opening, and be made of a unitary material or a composite of materials. Generally, this allows the eyeglass holding assembly is be designed to function as jewelry, so that whether the eyeglasses are retained or not, the assembly has an attractive appearance. For example, FIG. 1 shows a stylized hinge supporting the second element. The eyeglass holding assembly 1 can be made of or with precious or semi precious metals and gem stones, supported on a comparably styled necklace. Many different ornamental designs can be integrated with the eyeglass holding assembly while retaining the eyeglass holding function.

Figure 6A:
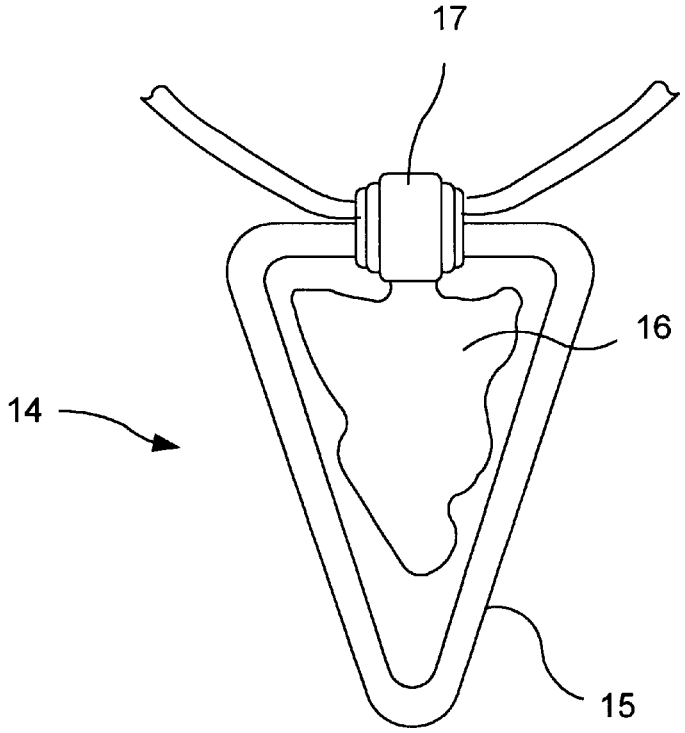
FIG. 6*b*** is a side view thereof.
Figure 6B:
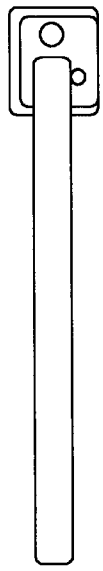

Referring to FIG. 6*a,* an eyeglass holding assembly 14 is shown having a first element 15 having a triangular shape, a second element 16 in the ornamental shape of an arrow, suspended from a hinge 17 in coaxial alignment with the first element, as shown in FIG. 6*b*. In this embodiment, no spring is used as the weight of the second element is sufficient to properly locate the second element in the eyeglass retaining position.

Using the present invention, a person has ready access to means for temporarily holding their eyeglasses without fear of loss, while maintaining an attractive appearance. The eyeglass holding assembly can be used with a necklace, and worn around the neck, or utilize a clip or other means to attach to a pocket, belt, etc. The positive retention of the eyeglasses avoids the inadvertent release of the eyeglasses, from movement, bending over, etc. A person thus can utilize an attractive piece of jewelry to store and hold their eyeglasses temporarily using the eyeglass holding assembly of the invention. This provides and easy and convenient way to temporarily store the eyeglasses and prevent loss.

While preferred embodiments of the present invention have been shown and described, it will be understood by those skilled in the art that various changes or modifications can be made without varying from the scope of the present invention.

What is claimed is:

1. An eyeglass holding assembly comprising a first element having a first diameter, and a second element having a second diameter, the second diameter being smaller than the first diameter, a hinge fixedly engaged to the first element and hingedly engaged to the second element, the first element having an opening of a size sufficient to accept an arm of a pair of eyeglasses therein, the arm received between the first element and the second element such that the pair of eyeglasses are supported by the first element and are retained by the second element in the opening.

2. The eyeglass holding assembly of claim 1 further comprising means for supporting the eyeglass holding assembly on a person.

3. The eyeglass holding assembly of claim 1 further comprising a supporting loop for supporting the eyeglass holding assembly on a necklace.

4. The eyeglass holding assembly of claim 1 wherein either or both of the first element and the second element have a shape selected from the group consisting of round, oval, square, rectangular, triangular, or another geometric shape, an ornamental shape, a heart shape, a star shape, an arrow shape, and combinations thereof.

5. The eyeglass holding assembly of claim 1 wherein a centerline of the second element is offset from a centerline of the first element.

6. The eyeglass holding assembly of claim 1 further comprising biasing means disposed on the hinge for biasing the second element into close proximity with the first element.

7. The eyeglass holding assembly of claim 1 wherein the biasing means biases the second ring into proximity to the first element.

8. The eyeglass holding assembly of claim 1 further comprising a spring disposed on the hinge for biasing the second element into close proximity with the first element.

* * * * *